United States Patent [19]

Taylor

[11] Patent Number: 4,909,433

[45] Date of Patent: Mar. 20, 1990

[54] DIVISIBLE SHIPPING CARTON

[76] Inventor: Janet G. Taylor, 5203 Verdon Ave., Los Angeles, Calif.

[21] Appl. No.: 202,966

[22] Filed: Jun. 6, 1988

[51] Int. Cl.[4] ..... B65D 5/48

[52] U.S. Cl. ..... 229/120.03; 206/602; 229/120.17; 229/120.18

[58] Field of Search ..... 229/120.03, 120.05, 229/120.17, 120.18, 192, 48 R; 206/602, 623, 627

[56] References Cited

U.S. PATENT DOCUMENTS

| | | | |
|---|---|---|---|
| 1,861,206 | 5/1932 | Burgess | 229/48 R |
| 2,178,076 | 10/1939 | Kondolf | 229/48 R |
| 2,335,366 | 11/1943 | Stearn | 229/120.17 |
| 2,342,564 | 2/1944 | Van Saun | 229/120.03 |
| 2,474,751 | 6/1949 | Morand | 206/602 |
| 2,693,308 | 11/1954 | Giroux et al. | 229/120.03 |
| 2,698,708 | 1/1955 | Margolies | 229/120.17 |
| 2,710,130 | 6/1955 | Grecco | 206/602 |
| 2,721,001 | 10/1955 | Hasselhoff | 229/120.17 |
| 2,804,254 | 8/1957 | Ness | 206/602 |
| 3,092,301 | 6/1963 | Selle | 206/602 |
| 3,252,646 | 5/1966 | Rockefeller | 206/602 |
| 4,377,252 | 3/1983 | Schillinger | 229/120.03 |

FOREIGN PATENT DOCUMENTS

| | | | |
|---|---|---|---|
| 114165 | 8/1984 | European Pat. Off. | 229/120.03 |
| 1079540 | 4/1960 | German Democratic Rep. | 206/602 |

*Primary Examiner*—Gary Elkins

*Attorney, Agent, or Firm*—Erik M. Arnhem

[57] ABSTRACT

A multicompartmented shipping carton is formed of a plurality of interdependent flap portions which are assembled by a succession of folding operations and which is secured by a plurality of interlocking tabs and slots. The carton is provided with a plurality of serrated portions in a manner permitting the division of the carton into two half portions which remain complete integral shipping containers of themselves. The assembly is achieved without the use of adhesives or tape of any kind and the closure of the carton and portions of the carton upon division is maintained entirely by the interlocking tabs and slots.

1 Claim, 5 Drawing Sheets

DIVISIBLE SHIPPING CARTON

FIELD OF THE INVENTION

This invention relates generally to shipping containers or cartons and particularly to those which include an interior constructed to form multiple cells for receiving individual products in separate containment.

BACKGROUND OF THE INVENTION

A wide variety of products pass through commerce in the form of shipments between manufacturers and distributors and between distributors and retailers. The majority of such products are shipped in an appropriately constructed shipping container. The shipping container for many products comprises a closed carton formed of a corrugated paper or cardboard material. While many different types of carton materials are utilized, the majority comprise multiple layers of heavy paper having an interposed corrugated layer secured to the surrounding layers by an adhesive to form a relatively ridged, strong and lightweight shipping material generally referred to as corrugated cardboard. While the construction of such shipping cartons vary substantially with the character of the product shipped, in general, most shipping cartons comprise an outer box portion having an openable or removable top portion for gaining access to the shipping carton interior. In many constructions the top or lid portion is integral to the remainder of the carton. In the event a product such as pharmaceutical material is shipped within such cartons, a plurality of interior segments or cells are formed within the carton interior to provide separate cells for each of the units of pharmaceutical products. Most commonly, such multiple cells are formed by an additional unit comprising a lattice arrangement of cardboard separations which is configured to be received within the carton interior.

Because the majority of products, such as pharmaceutical products, are subject to multiple successive shipments in their transfer from the manufacturer to one or more distributors and from there to the retailers, a problem arises as the individual orders become smaller and smaller. For example, the manufacturer of a pharmaceutical product may ship a substantial number of pharmaceutical units to a distributor and the distributor will divide the total shipment between a number of retail customers. Thus, the situation arises in which the original shipping container used by the manufacturer in transferring the product to the distributor is not appropriate in size for the shipments of the distributor to the retailer. In most instances, it has been found necessary to repack the shipments received by the distributor from the manufacturer into other shipping containers or cartons for multiple shipments to the retailer. This repacking operation is, of course, time consuming and costly and subjects the phramaceutical product to additional risk of damage or breakage.

In addition to the problems associated with repackaging of the pharmaceutical product in the distribution chain, the packages themselves are generally expensive to manufacture. The typical shipping container having the multicelled structure described above is formed of multiple parts of corrugated cardboard material cut in particular shapes and sizes and impressed with multiple folds. The assembly of the packaging structure is completed by gluing the several parts together in what is a generally expensive manufacturing process.

While the present shipping containers provide some level of function and use in shipping products in multicelled containers, there remains a need in the art for a shipping carton which is formed of a single piece of material, assembled without the use of adhesives, and which is easily divisible into smaller shipping cartons while maintaining the integrity of the shipping carton and protection of the product.

SUMMARY OF THE INVENTION

Accordingly, it is a general object of the present invention to provide an improved shipping carton. It is a more particular object of the present invention to provide an improved shipping carton which is easily divisible into a pair of smaller shipping cartons. It is a still more particular object of the present invention to provide an improved readily divisible shipping carton which is formed of a single piece of material and assembled without the use of adhesives.

BRIEF DESCRIPTION OF THE DRAWINGS

The features of the present invention, which are belived to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
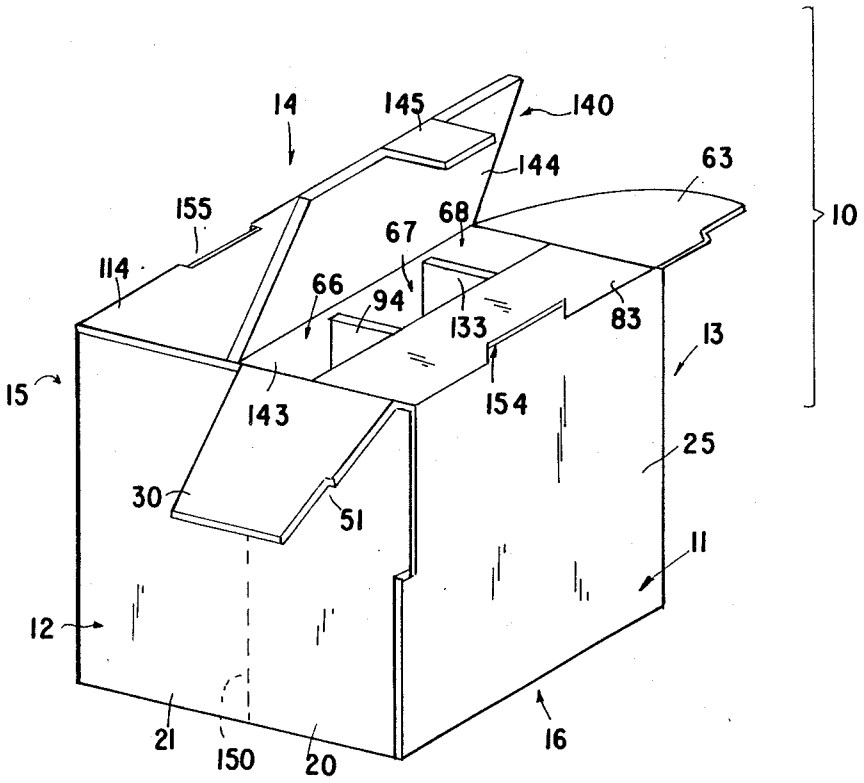
FIG. 1 is a perspective view of a divisible shipping carton constructed in accordance with the present invention in a partially open position.

FIG. 1 sets forth a perspective view of a shipping carton generally referenced by the numeral 10 and constructed in accordance with the present invention. Carton 10 comprises a generally rectangular shape having a front 11, a back 15, a side 12, a side 13, a bottom 16 and a top 14. Front 11 comprises a flat facet 25 having a slot 154 at its intersection with top 14. Side 12 comprises a pair of facets 20 and 21 joined by a serrated line 150, the details of which are set forth below in greater detail. While not visible in FIG. 1, side 13 is similar in construction to side 12 and comprises a pair of facets 23 and 24 separated by a serrated line 153 (better seen in FIG. 3). In accordance with a structure set forth below in greater detail, carton 10 defines a plurality of internal compartments such as compartments 66, 67 and 68 extending downwardly within carton 10 and configured to receive an elongated product such as a pharmaceutical container. By structure set forth below in greater detail, top 14 is divided into a pair of facets 114 and 144 which extend upwardly through the center of top 14 and are movable between a position of closure shown for facet 114 and an open position shown for facet 144.

Facet 144 supports a tab 145. Facet 114 supports a similar tab 115 (seen in FIG. 3). Top 14 further comprises an inwardly extending facet 83 which defines a slot 154. A pair of outwardly extending flaps 63 and 30 are foldable between the open positions shown in FIG. 1 and a closed inward position in which flaps 30 and 63 overlie facet 83 and compartments 66 through 68. With the exception of open facet 144, flaps 63 and 30, carton 10 is shown in FIG. 1 in its fully closed and assembled position.

In its intended use, carton 10 defines a plurality of internal compartments such as compartments 66 through 68 which receive a corresponding plurality of products such as pharmaceutical containers. In the embodiment shown in FIG. 1, carton 10 defines a similar row of compartments parallel to compartments 66 through 68 which are covered in FIG. 1 by facet 83. Similarly, facet 114 covers a second group of compartments. In the embodiment shown in FIG. 1, carton 10 defines four rows of three compartments each giving carton 10 a total number of twelve individual compartments. It will be apparent to those skilled in the art, however, that different numbers of compartments may be constructed in accordance with the invention without departing from the spirit and scope of the present invention. Once all the compartments of carton 10 have been filled with pharmaceutical product, the closure of compartment 10 is completed by folding flaps 30 and 63 inward and thereafter folding facet 44 downwardly to overlay flaps 30 and 63 while extending tab 145 into slot 154. When thus configured, carton 10 is completely closed and forms a single integral shipping container supporting twelve pharmaceutical products.

In accordance with an important aspect of the present invention, once carton 10 is closed the pharmaceutical products therein may be shipped in conventional manner without additional packaging and all twelve pharmaceutical products housed within the twelve internal compartments of carton 10 will be securely packaged and protected. As mentioned above, in typical shipping use, carton 10 is initially utilized to transfer twelve units of pharmaceutical product to a distributor or other party within the distribution chain having a need to further distribute the product.

Figure 2:
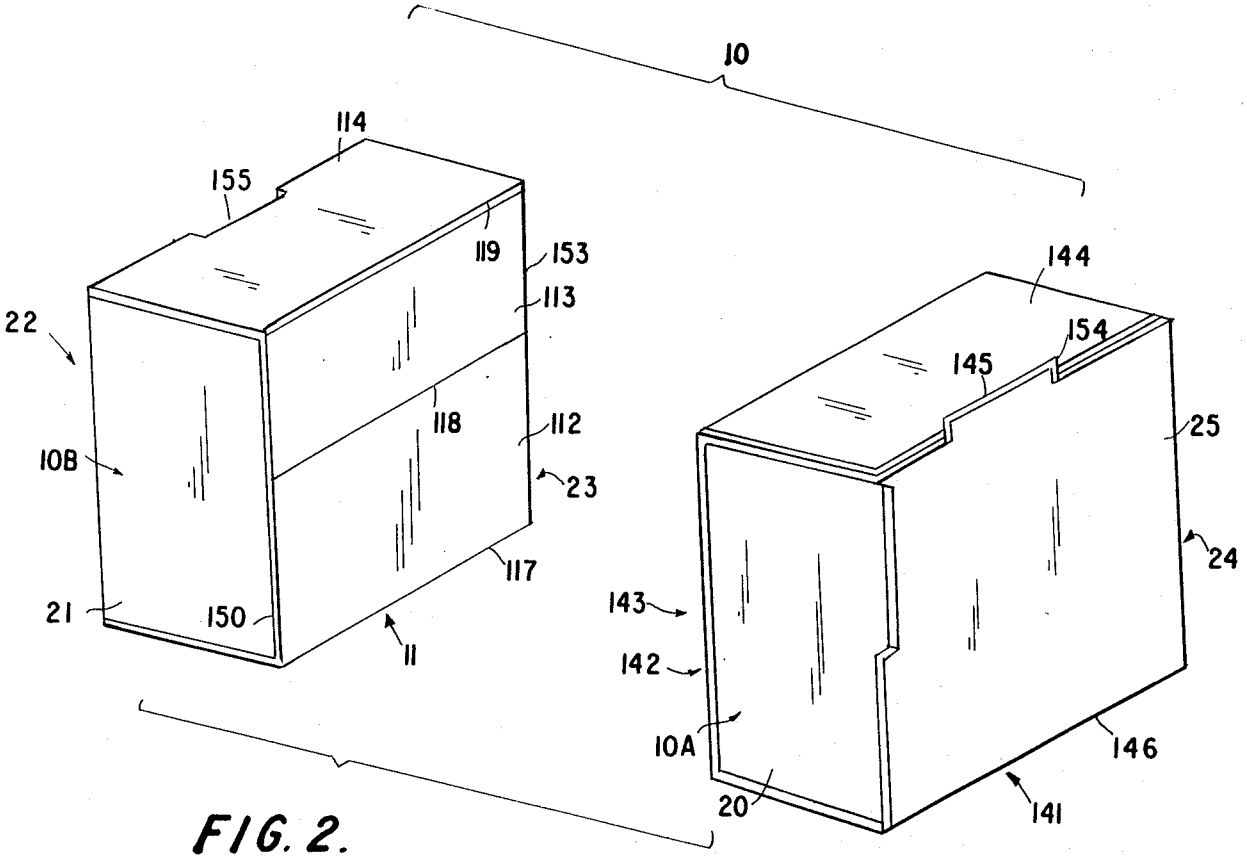
FIG. 2 shows a perspective view of the shipping carton of FIG. 1 in a completely closed position having the two halves separated.

FIG. 2 sets forth carton 10 in its closed position once separation has occurred by severing serrated lines 150 and 153. As can be seen by comparing FIGS. 1 and 2, carton 10 has now been divided into two integral shipping containers, each supporting the pharmaceutical product contained therein and each having half the volume of the assembled carton of FIG. 1. The separation of portions 10A and 10B of carton 10 as shown in FIG. 2, is in accordance with an important aspect of the present invention achieved solely by the separation of serrated lines 150 and 153. Thus, sides 12 and 13 are readily severable along serrated lines 150 and 153 respectively. Portion 10A of carton 10 now comprises an integral shipping carton of itself in accordance with an important aspect of the present invention having a front portion comprising facet 25, a rear portion comprising facet 143, a side portion comprising facet 20, a side portion comprising facet 24, a bottom portion comprising facet 141 and a top portion comprising facet 144. Similarly, portion 10B forms a second integral packing carton having a front portion formed by facet 22, a rear portion formed by facets 112 and 113, a side portion formed by facet 23, a side portion formed by facet 21, a bottom portion formed by facet 111 and a top portion formed by facet 114.

In its normal use portions 10A and 10B, once separated in the manner shown in FIG. 2, may be used to divide the quantity of pharmaceutical product originally contained within and shipped within carton 10 in the configuration shown in FIG. 1 without the necessity of repacking the container contents in smaller packing cartons. Thus, a substantial portion of the normal costs associated with the distribution of pharmaceutical products and the like is avoided and the risk of damage to the products contained therein is considerably reduced.

Figure 3:
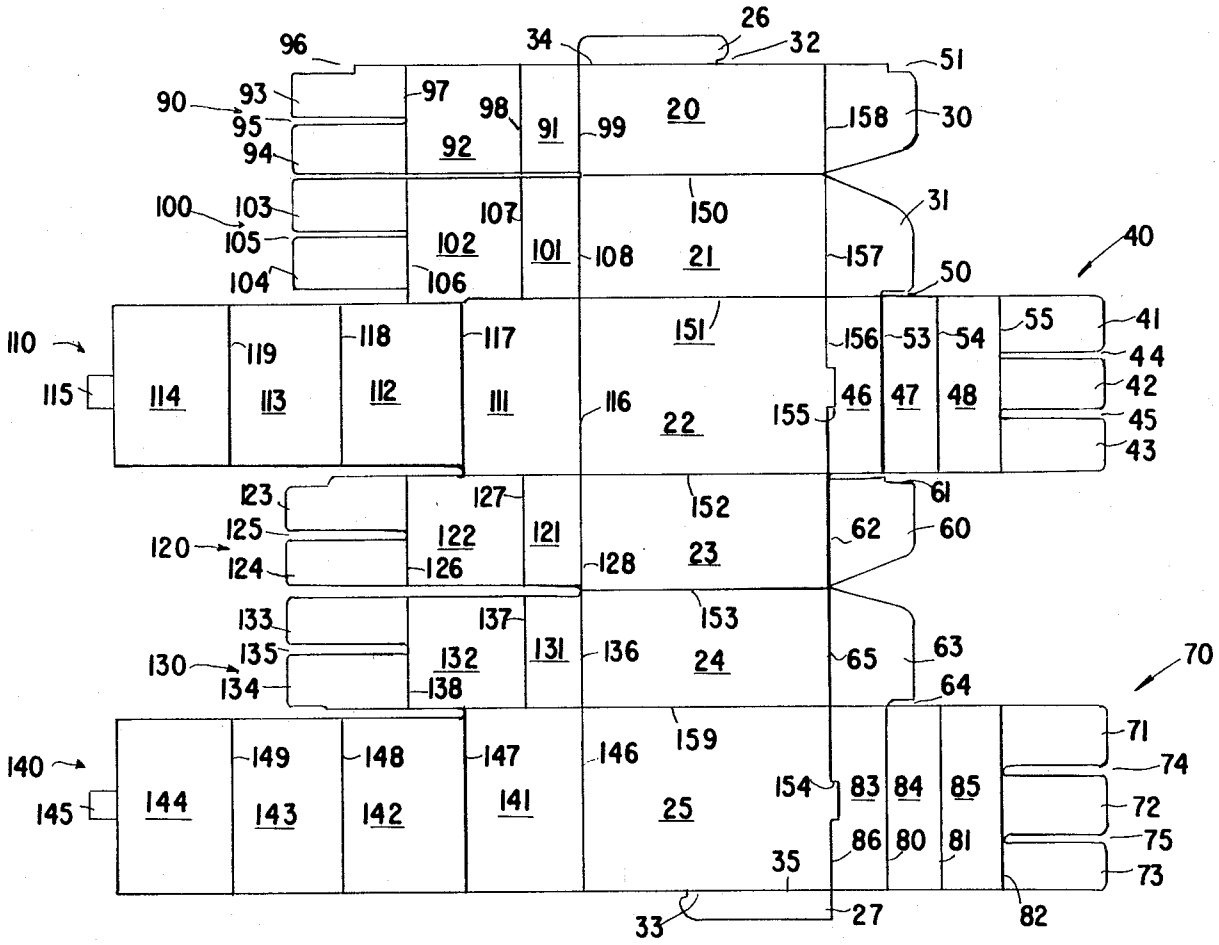
FIG. 3 is a planned view of the present invention shipping carton in a completely unfolded configuration.

FIG. 3 sets forth the present invention carton 10 in its completed disassembled and completely unfolded configuration. It should be noted initially that carton 10 is formed of a single continuous piece of corrugated cardboard material or the like and as will be shown is in accordance with an important aspect of the present invention completely assembled without the use of any adhesives, tapes or other similar materials.

Carton 10 defines a plurality of rectangular shaped facets 20, 21, 22, 23 and 24 configured in a serial arrangement. Facets 20 and 21 are joined by a serrated line 150 while facets 21 and 22 are joined by a fold line 151. Similarly, facets 22 and 23 are joined by a fold line 152 and facets 23 and 24 are joined by a serrated line 153. Finally, facets 24 and 25 are joined by a fold line 153. An elongated tab 26 is joined to facet 20 at a fold line 34 and defines an internal notch 32. A tab 27 is joined to facet 25 by a fold line 35 and defines a similar notch 33. It should be noted that tabs 26 and 27 are of similar configuration and are oppositely positioned with respect to each other. A pair of flaps 30 and 31 are joined to facets 20 and 21 by a pair of fold lines 158 and 157 respectively. A multiply folded flap 40 defines a trio of outwardly extending flaps 41, 42 and 43 separated by slots 44 and 45 respectively. Flap 40 is joined to facet 22 by a fold line 156 and defines an elongated slot 155. Flap 140 further defines a trio of fold lines 53, 54 and 55 which separate flap 40 into facets 46, 47 and 48 respectively. A pair of flaps 60 and 63 extend outwardly from facets 23 and 24 and are joined thereto by fold line 62 and 63 respectively. Flaps 60 and 63 further define notches 61 and 64 respectively. It should be noted that flaps 30 and 31 are virtually identical to flaps 60 and 63 respectively. A flap 70, identical to flap 40, is joined to facet 25 by a fold line 86 and defines an elongated slot 154 and a trio of flaps 71, 72 and 73 separated by slots 74 and 75 repectively. It should be noted that flap 70 is identical to flap 40 and thus defines facets 83, 84 and 82 formed by fold lines 86, 80, 81 and 82 respectively.

A flap 90 is joined to facet 20 at a fold line 99 and defines a pair of flaps 93 and 94 separated by a slot 95. Flap 93 further defines a notch 96. Flap 90 is divided by fold lines 97 and 98 to form facets 92 and 91 respectively. A flap 100, which is the mirror image of flap 90, is joined to facet 21 at a fold line 108 and defines a pair of flaps 103 and 104 separated by a slot 105. Flap 100 is further divided by fold lines 106 and 107 to form facets 102 and 101 respectively.

A flap 110 is joined to facet 22 by a fold line 116 and defines an outwardly extending tab 115. Flap 110 is divided into facets 111, 112, 113 and 114 by fold lines 117, 118 and 119 respectively.

A flap 120, identical to flap 90, is joined to facet 23 by a fold line 128 and defines a pair of flaps 123 and 124 separated by a slot 125. Flap 120 is divided into facets 121 and 122 by fold lines 127 and 126 respectively. Flap 130 is identical to flap 100 and is joined to facet 24 by a fold line 136. Flap 130 defines a pair of flaps 133 and 134 separated by a slot 135 and is divided into facets 131 and 132 by fold lines 137 and 138 respectively. A flap 140 is identical to flap 110 and is joined to facet 25 at fold line 146 and defines an outwardly extending tab 145. Flap 140 is further divided into facets 141, 142, 143 and 144 by fold lines 147, 148 and 149.

It should be noted that the fold lines referred to in FIG. 3 form linear creases about which the various facets joined by the fold lines may be readily folded without distorting the facet. Thus in accordance with an important aspect of the present invention and in accordance with the assembly process set forth below in greater detail, the entire manipulation of the various facets and flaps of the present invention carton may be undertaken without the need to distort or bend any of the material facets. Thus, the entire carton may be assembled from a substantially rigid and high strength material if desired. In addition, it should be noted that serrated lines 150 and 153 are formed by multiple piercings of the material to produce a line along which the material may be readily torn when subjected to a strong separating force. As mentioned above and with temporary reference to FIGS. 1 and 2, it is the capability of serrated lines 150 and 153 to be severed readily which permits the separation of the present invention carton into two complete units without the need for any cutting tools.

Figure 4:
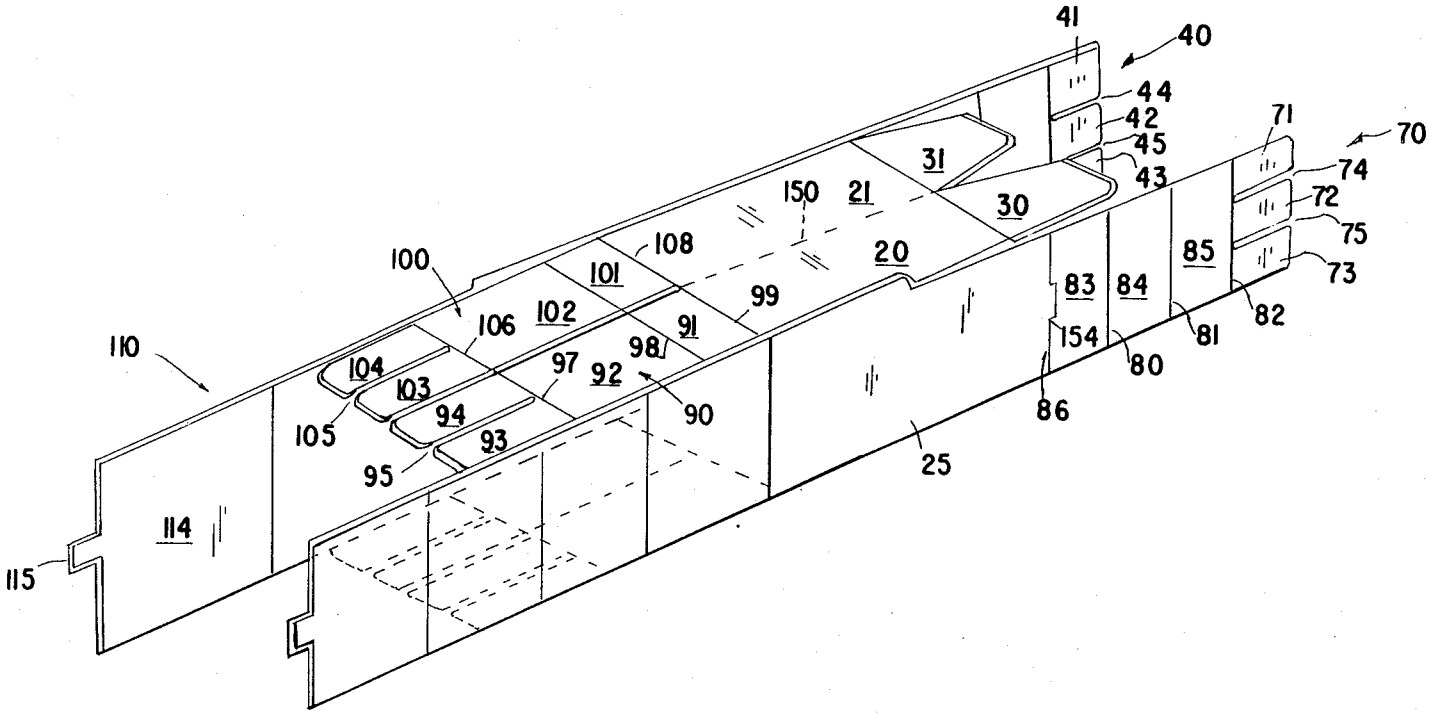
FIG. 4 is a perspective view of the present invention shipping carton partially assembled.

FIG. 4 sets forth the present invention carton configured in its initial step of assembly. The first step of assembly of carton 10 is carried forward by folding facets 20 through 25 about fold lines 151, 152 and 159 to form a generally rectangular structure. Thereafter, tabs 26 and 27 are bent inwardly about fold lines 34 and 35 respectively to extend into the interior of the rectangular structure thus formed. Thereafter, notches 33 and 32 are joined to cause tabs 26 and 27 to maintain an attachment between facet 25 and facet 20. With the foregoing initial step of assembly complete, the present invention carton assumes the position shown in FIG. 4. As can be seen at this point by examination of FIG. 4, facets 20, 21, 22, 23, 24 and 25 form a rectangular structure in which facets 25 and 22 form two opposite sides and in which facets 21 and 20 form the third side and facets 23 and 24 form the bottom or fourth side. It should be noted that facets 21 and 20 are coplanar and the structure is not folded along serrated line 150. While not seen in FIG. 4, it should be understood that facets 23 and 24 are coplanar and are not folded along serrated line 153. In the position shown, flaps 70 and 40 extend outwardly from facets 25 and 22 respectively. Similarly, flaps 31 and 30 extend outwardly from facets 21 and 20 respectively and while not shown in FIG. 4 it should be understood that flaps 60 and 63 are similarly outwardly extending from facets 23 and 24. In the same manner, it should be noted that flaps 140 and 110 extend outwardly from facets 25 and 22 respectively and that flaps 90 and 100 extend outwardly from facets 20 and 21. Similarly, flaps 120 and 130 extend outwardly from facets 23 and 24.

The next assembly step comprises folding flaps 90 and 100 about fold lines 98 and 97 to cause facets 101 and 91 to form right angles with facets 20 and 21 respectively and to cause facets 92 and 102, as well as flaps 93, 94, 103 and 104, to extend upwardly through the interior of the carton structure. Similarly, flaps 120 and 130 are folded to cause facets 122 and flaps 123 and 124, as well as facet 132 and flaps 133 and 134, to similarly extend upwardly through the interior of the carton structure. With the folding of flaps 90, 100, 120 and 130 thus completed, flap 140 is folded along fold lines 147, 148 and 149 to cause facet 141 to form one-half of the bottom structure of the shipping carton and to direct facets 142, 143 and 144 upwardly through the interior of the carton structure and between flaps 90 and 100 and flaps 120 and 130. Finally, flap 110 is folded in a similar manner to flap 140 and directed upwardly through the interior of the carton structure such that facet 114, 113 and 112 extend through the center of the carton structure between flaps 90 and 100 and between flaps 120 and flaps 130. With the foregoing step of assembly completed, the carton assumes the configuration shown in FIG. 5.

Figure 5:
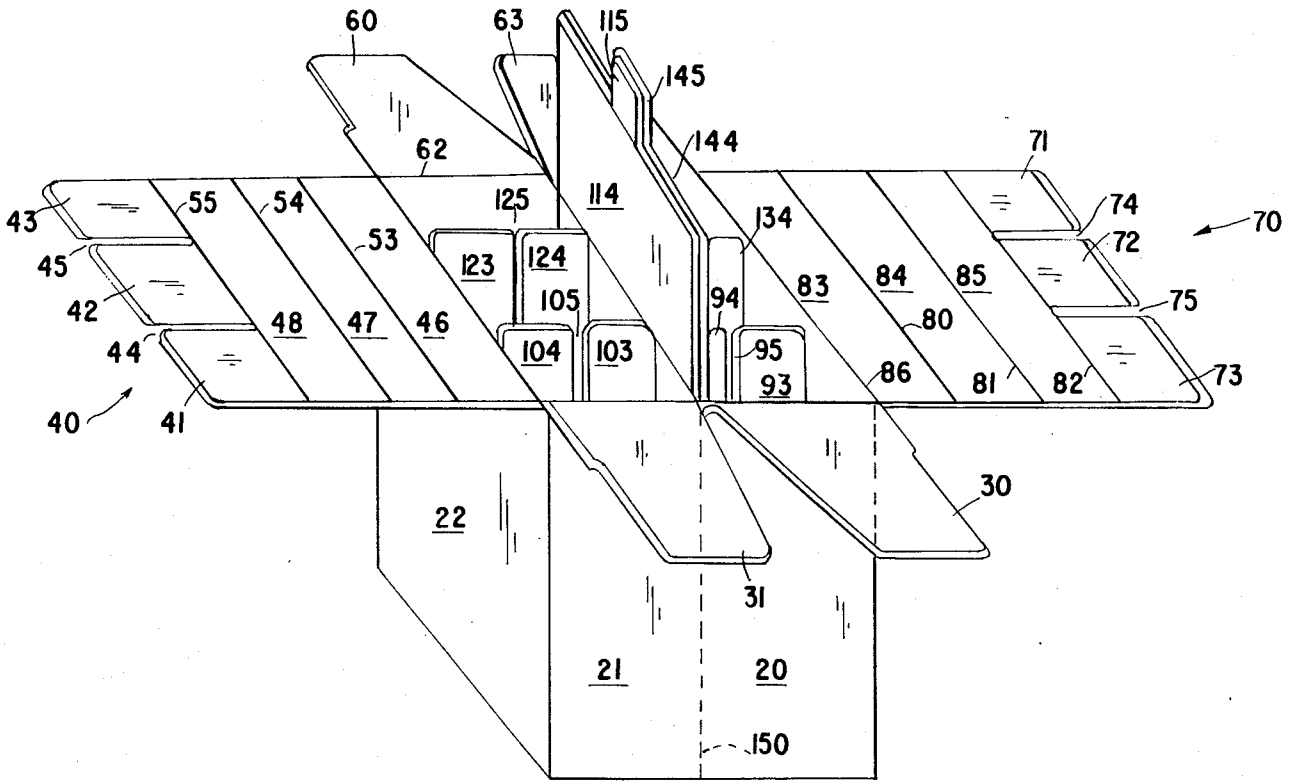
FIG. 5 is a perspective view of the present invention shipping carton in a partially assembled configuration.

FIG. 5 sets forth the present invention carton in a partial state of assembly in accordance with the foregoing descriptions which corresponds to the configuration of carton 10 in which carton 10 may be packed or loaded with the to-be-shipped pharmaceutical materials. It should be noted that as configured in FIG. 5, flaps 70 and 40 extend outwardly as to flaps 60, 63, 30 and 31. It should also be noted that facet 114 and facet 44 extend upwardly from the center portion of the carton interior. In addition, flaps 123 and 124, as well as flaps 104 and 103, extend upwardly through the interior of the carton. Similarly, while not visible in FIG. 5, flaps 93 and 94 and flaps 133 and 134 are similarly configured to extend upwardly through the interior of the carton. In the position shown, six individual pharmaceutical products may be positioned within each portion of the present invention carton to load a complete complement of twelve units into the carton interior. In the next assembly step, flap 40 is folded along fold lines 156, 53, 54 and 55 such that flaps 41, 42 and 43 pass between flaps 123 and 124 and flaps 104 and 103 until slots 45 and 44 are received within slots 125 and 105 respectively. Thereafter, flaps 41, 42 and 43, as well as facets 48 and 47, are directed downwardly to form a separating wall between the two rows of three compartments formed within container 10. Once flap 40 is folded in the manner described, flaps 31 and 60 are folded inwardly to overlie facet 46 of flap 40 and closure is completed by folding facet 114 to overlie flaps 31 and 60 and extend tab 115 through slot 155. With the foregoing assembly completed, the closure of one-half of the present invention carton is completed. Next, a similar folding of flap 70 to that described for flap 40 is carried forward in which flaps 71, 72 and 73 are directed downwardly such that slots 74 and 75 are received within slots 135 and 95 and such that flaps 71, 72 and 73, as well as facets 84 and 85, form an interior separating wall to isolate the pharmaceutical products within the carton half. With the carton assembled to this point, the carton assumes the configuration shown in FIG. 1 and assembly is completed by folding flaps 30 and 63 inwardly to overlie facet 83 and folding facet 144 downwardly to overlie flaps 30 and 63 and directing tab 145 through slot 154. At this point, the assembly of the present invention carton is complete and 12 individual interior compartments are formed within the carton interior.

Thereafter, the completely filled carton may be shipped without further use of tapes or adhesives and during the redistribution process may be readily separated into two individual carton portions, each forming integral shipping containers in themselves and each containing six of the interior compartments. Thus, the twelve products packed within the present invention carton may be divided into lots of six each without any need to open the carton or repackage the product in any way.

What has been shown is a novel shipping carton formed of a single unitary piece of material without the use of tapes or adhesives which permits the separation of the carton into two smaller integral cartons by a simple and easy means and without the need to repackage the material.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope the invention.

That which is claimed is:

1. A divisible shipping carton comprising:

a rectangular enclosure having first, second, third and fourth mutually perpendicular sides defining an interior enclosure said first and third sides defining center lines, and said first and second sides each defining an extending tab, said tabs being configured to interlock and join said first side to said second side to complete said rectangular enclosure;

a bottom surface formed of first and second bottom surface facets;

a top surface formed of first and second top surface facets;

a plurality of interior separations extending from said top surface to said bottom surface forming a plurality of cells within said enclosure;

a first center wall within said enclosure spanning said first and third sides and joining said first bottom surface facet to said first top surface facet;

a second center wall within said enclosure spanning said first and third sides and joining said second bottom surface facet to said second top surface facet; and said first bottom facet and said first center wall are serially joined to said second side and said second bottom facet and said second center wall are serially joined to said fourth side, said first and second center walls are continuous with said first and second top and bottom surface facets respectively; means for separating includes serrated tear lines parallel to said first and second center walls, and said plurality of interior separation include third and fourth bottom facets continuous with said first and third, sides, respectively, third and fourth top facets continuous with said second and fourth sides, respectively, first and second foldable tabs continuous with and extending from said third and fourth bottom facets respectively upwardly within said enclosure; and third and fourth foldable tabs continuous with and extending from said third and fourth top facets respectively downwardly into said enclosure, said first, second, third and fourth tabs extending upwardly within said interior enclosure to form said interior separations, and means for separating said carton along the center lines of said first and third sides to form a pair of individual cartons.

* * * * *